United States Patent [19]

Sensabaugh, Jr. et al.

[11] Patent Number: 4,765,347

[45] Date of Patent: Aug. 23, 1988

[54] AEROSOL FLAVOR DELIVERY SYSTEM

[75] Inventors: Andrew J. Sensabaugh, Jr., Winston-Salem; Henry T. Ridings, Lewisville, both of N.C.

[73] Assignee: R. J. Reynolds Tobacco Company, Winston-Salem, N.C.

[21] Appl. No.: 861,178

[22] Filed: May 9, 1986

[51] Int. Cl.[4] ..... A24D 1/00; A24D 1/04; A24D 47/00

[52] U.S. Cl. ..... 131/273; 131/173; 131/335

[58] Field of Search ..... 131/270, 271, 272, 273, 131/173, 335

[56] References Cited

U.S. PATENT DOCUMENTS

| | | |
|---|---|---|
| 726,037 | 4/1903 | Ferre . |
| 962,617 | 6/1910 | Bucceri . |
| 2,425,624 | 8/1947 | Lardinois . |
| 2,445,476 | 7/1948 | Folkman . |
| 2,721,551 | 10/1955 | Lobl . |
| 2,764,154 | 9/1956 | Murai . |
| 2,860,638 | 11/1958 | Bartolomeo . |
| 3,200,819 | 8/1965 | Gilbert . |
| 3,250,280 | 5/1966 | Yow-Jiun Hu . |
| 3,347,231 | 10/1967 | Chien-Hshuing Chang . |
| 3,404,692 | 10/1968 | Lampert . |
| 3,508,558 | 4/1970 | Seyburn ..... 131/173 |
| 4,079,742 | 3/1978 | Rainer et al. . |
| 4,083,372 | 4/1978 | Boden . |
| 4,284,089 | 8/1981 | Ray . |
| 4,393,884 | 7/1983 | Jacobs . |
| 4,429,703 | 2/1984 | Haber . |
| 4,569,136 | 2/1986 | Loring . |
| 4,657,032 | 4/1987 | Dorr et al. . |

FOREIGN PATENT DOCUMENTS

| | | |
|---|---|---|
| 0148749 | 7/1985 | European Pat. Off. . |
| 0150810 | 8/1985 | European Pat. Off. . |
| 5469381 | 3/1984 | Japan . |
| 5779484 | 3/1984 | Japan . |
| 9513384 | 5/1984 | Japan . |
| 86/02528 | 11/1984 | PCT Int'l Appl. . |

*Primary Examiner*—V. Millin

[57] ABSTRACT

A flavor delivery article produces an aerosol. The article includes an outer container in the form of a tube and an inner container disposed within the outer container. The inner container contains liquid such as an alcohol-water mixture, and a delivery means such as a tube. An airflow acceleration means is located near the output region of the delivery means such that airflow through the outer container can disperse the liquid from the delivery means into the airflow in aerosol form.

3 Claims, 3 Drawing Sheets

AEROSOL FLAVOR DELIVERY SYSTEM

BACKGROUND OF THE INVENTION

This invention relates to a flavor delivery system, and in particular to a flavor delivery system which delivers flavor by means of an aerosol generated by mechanical dispersion of a liquid into a flowing gas stream.

Although smoking articles such as cigarettes have remained as popular consumer products, various new types of cigarette-type flavor delivery systems have been proposed. For example, as proposed in U.S. Pat. No. 4,079,742 to Rainer et al, tobacco substitutes can be provided from a wide variety of treated and untreated plant materials. However, it is believed that various types of tobacco substitutes, such as are provided by the modification of cellulose materials, are not completely satisfactory as a tobacco substitute.

Numerous aerosol generating smoking articles based on heat generation have been proposed. For example, U.S. Pat. No. 2,907,686 to Siegel proposes a cigarette substitute which includes an absorbent carbon fuel source and a flavoring agent. The flavoring agent is carried by the burnable fuel source and thereby provide hot gases. In addition, U.S. Pat. Nos. 3,258,015 and 3,356,094 to Ellis et al have proposed smoking articles whereby a fuel source of fine cut tobacco surround a tube containing a source of nicotine. Furthermore, substitute cigarette filler materials such as carbon fibers treated with flavorant are proposed in U.S. Pat. Nos. 3,738,374 to Bennett; 3,943,941 to Boyd; 4,044,777 to Boyd; 4,286,604 to Ehretsmann et al; 4,326,544 to Hardwick et al and British Patent No. 1,431,045. More recently, U.S. Pat. No. 4,340,072 to Bolt et al proposes a smoking article comprising a fuel rod having a central air passageway and a mouthend chamber containing an aerosol forming agent in the form of granular microcapsules. Another type of smoking article is disclosed in U.S. Pat. No. 3,515,417 to Moses.

A number of flavor delivery systems or simulated smoking devices which produce an aerosol or vapor without the application of heat also have been proposed. For example, wick-type devices are disclosed in U.S. Pat. Nos. 4,083,372 to Boden and 4,429,703 to Haber. Devices having pressurized substances are disclosed in U.S. Pat. No. 4,393,884 to Jacobs. A highly position sensitive aerosol generating device is disclosed in U.S. Pat. No. 2,764,154 to Murai. U.S. Pat. No. 2,445,476 to Folkman discloses a device having a tubular body of flexible material containing an air pervious filler saturated with a volatile oil, with plugs positioned at each end of the tube.

The aerosol generating smoking articles have not achieved any substantial commercial acceptance. The absence of such smoking articles from the marketplace is believed to be due to a variety of factors, including insufficient aerosol generation, poor taste, off taste due to the thermal degradation of the smoke forming agent and/or flavoring agents, the presence of substantial pyrolysis products and sidestream smoke, and unsightly appearance.

In addition, the heatless flavor delivery systems which have been proposed appear to be awkward to employ, provide inconsistent flavor generation, and often require use of absorbent materials and/or elaborate seals in order to prevent the flavor generating composition from escaping from the device prior to use.

In view of the deficiencies of the prior art, it would be highly desirable to provide a flavor delivery article essentially exhibiting the appearance of a conventional cigarette capable of delivering an aerosol without the application of heat.

SUMMARY OF THE INVENTION

The present invention relates to a flavor delivery article having (a) an outer container providing a pathway for airflow therethrough;

(b) an inner container disposed within the outer container and containing a liquid, the inner container having a delivery means having an output region for output of the liquid;

(c) an airflow acceleration means located near the output region of the delivery means; and (d) a mouthend region;

wherein the output region of the delivery means and the airflow acceleration means are arranged in a relationship such that puff induced airflow through the outer container experiences a pressure drop adjacent the output region of the delivery means relative to the pressure experienced by the liquid contained within the inner container, which pressure drop is sufficient to disperse liquid from the output region of the delivery means into the airflow to form an aerosol in the mouthend region.

As used herein, the term "aerosol" indicates a suspension of fine liquid particles in a gas phase.

In operation, the user draws upon the article as in done with a conventional cigarette thereby creating an airflow from the intake end, through the outer container, and toward the output end thereof. The airflow is accelerated upon passing through the airflow acceleration means, and the resulting high velocity airflow in the vicinity of a nozzle-type tip of the delivery means produces a pressure drop at the output end thereof relative to the pressure experienced by the liquid within the inner container. The resulting pressure drop causes droplets of liquid to flow through the delivery means from the inner container and towards the output end of the delivery means. The droplets of liquid become entrained in the airflow as an aerosol from the delivery means, and the aerosol is delivered through the output end of the article to the user through the mouthend piece.

The flavor delivery article is capable of providing substantial quantities of aerosol, both initially and over the useful lifetime of the product, without the necessity of burning a material such as tobacco. Of particular interest is the fact that the article of this invention can be employed without the necessity of burning any material. In addition, the article delivers aerosol only when drawn upon by the user.

The flavor delivery article can provide a wide variety of flavorants in aerosol form. Of particular interest is a liquid flavorant having the ability to provide an aerosol having the characteristic taste of mainstream cigarette smoke. Also of interest are aerosols which deliver caffeine as well as pharmacologically or physiologically active materials.

The flavor delivery article offers the user a convenient and viable alternative to cigarettes. Specifically, the article can have the appearance, feel and draft characteristics of a conventional cigarette. Thus, the article can provide the user with many of the sensations and benefits of cigarettes without burning tobacco or providing any other product of thermal degradation of materials.

DETAILED DESCRIPTION OF THE EMBODIMENTS

Figure 1:
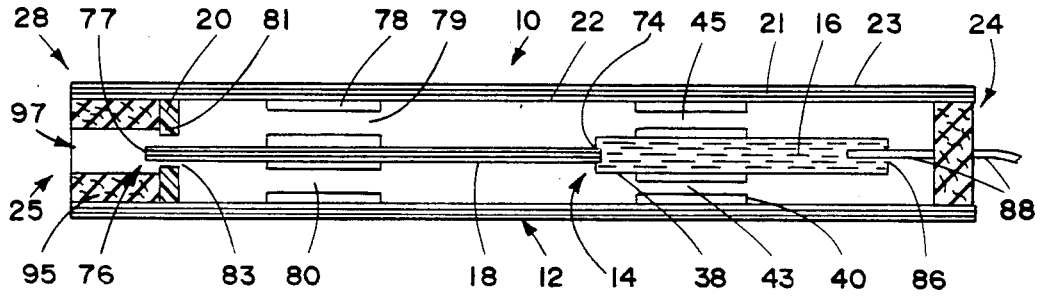
FIGS. 1, 2 and 3 are diagrammatic, longitudinal cross sectional views of embodiments of flavor delivery articles of this invention.
Figure 2:
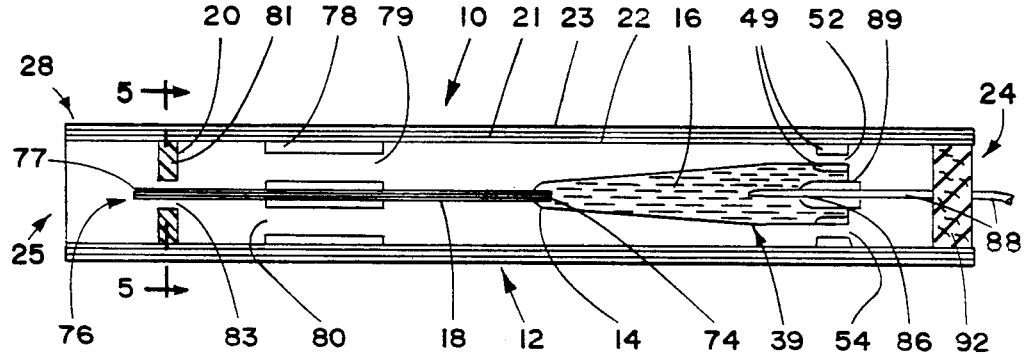
Figure 3:
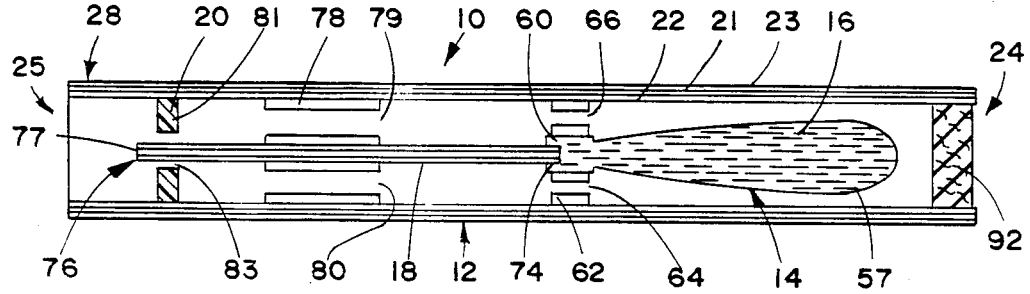

The embodiments of the invention illustrated in FIGS. 1, 2 and 3 show flavor delivery article 10 which preferably resembles a conventional cigarette in weight, color, size, shape, feel, and the like. The embodiments include an outer container 12 which acts as an envelope, and preferably has an elongated, or generally tubular shape. The embodiments further include an inner container 14 for a liquid 16 and a delivery means 18, all of which are disposed or mounted in outer container 12. The embodiments also include an airflow acceleration means 20.

The outer container 12 most preferably and is constructed from foil lined paper. In the embodiments shown, the outer container is constructed from a paper 21 outer layer lined with metallic foil 22 such as an aluminum foil. For aesthetic purposes, the outer container can be covered with cigarette paper wrap 23. If desired the outer container can be constructed from cardboard, plastic, glass, paper, and the like, and combinations thereof. Preferably, the outer container exhibits some rigidity in order to provide good support for the flavor delivery article, and preferably has the rigidity which approximates or simulates that of a conventional cigarette.

The outer container 12 has an intake end 24 and an output end 25. The intake end corresponds to the fire end of a conventional cigarette. The output end corresponds to the mouthend of a conventional cigarette. The mouthend comprises mouthend region 28. The outer container is constructed in order that when the mouthend of the article is placed in the mouth of the user and drawn upon, (i.e., when puffing occurs) the resulting airflow through the outer container defines a path from intake end 24 to output end 25.

The mouthend region 28 can be indicated to the user by simulating the appearance of cork colored tipping paper at the output end of the article, by ink rings encircling the outer surface of the article, or by other such means. A suitable mouthend region or piece provides a channel which permits the aerosol to be conveyed into the mouth of the user. Preferably, the inner portion of the mouthend region is substantially inert with respect to the aerosol, and offers minimum aerosol loss by condensation or filtration effects. Typically, the mouthend region has a liquid (eg., moisture) proof inner layer or surface, such as can be provided by foil lining, or the like. Preferably, the outer container forms the mouthend region. However, the mouthend region can be provided separately such as in the form of a removable, reusable piece, a cigarette holder, or the like. The outer surface of the mouthend piece can be coated with a non lip-sticking material such as wax, nitrocellulose, or the like. The length of the mouthend region can vary depending upon factors such as the character of the aerosol which is formed.

Inner container 14 is disposed within the outer container. By this is meant that the inner container is positioned and mounted within the outer container during conditions of normal use of the flavor delivery article, while permitting the required path for airflow through the outer container. If desired, the inner and outer containers can be provided as separate parts, and assembled by the user. The inner container can have a variety of sizes and shapes. Typically, the inner container has a size sufficient to contain from about 0.5 ml to about 2 ml, preferably from about 1 ml to about 1.5 ml of liquid.

In the embodiment shown in FIG. 1, the inner container 14 has the shape of a cylinder 38 which is held in place within the outer container by a cellulose acetate plug 40 which circumscribes the cylinder and maintains contact with the inner surface of the outer container. The plug extends along the length of the inner container in an amount sufficient to provide the necessary support of the inner container within the outer container. A path of airflow through the outer container is provided by a plurality or series of passageways 43 and 45, such as holes, peripheral grooves, or other such suitable passages which extend longitudinally along or through the plug. Other means for supporting and holding the inner container in place within the outer container includes similarly positioned screen like materials, corrugated materials, or other such materials capable of providing a path of airflow through the outer container.

In the embodiment shown in FIG. 2, the inner container 14 has a substantially elongated shape. Preferably, the cross sectional diameter of the inner container is greater towards the input end of the flavor delivery article relative to the output end thereof thereby providing a substantially cone-shaped inner container 39. In this embodiment, inner container 14 includes an outwardly extending positioning member 49 which has been formed integrally therewith or fixedly secured to the outside surface of the inner container in order to position and hold the inner container within the outer container towards the input end of the flavor delivery article. The positioning member can be material which is molded to surround the inner container, a separate encircling ring, formed with the outer container, or the like. The positioning member has a cross sectional diameter which approximates the inner diameter of the outer container such that the inner container can be effectively held in place within the outer container. A path of airflow through the outer container is provided by a plurality or series of passages 52 and 54, grooves, or the like, which extend longitudinally through positioning member 49.

In the embodiment shown in FIG. 3, a portion of the inner container 14 is constructed from a pliable material, and is in the form of a sack 57, or other appropriate shape. The pliable material can be a thermoplastic material such as a polyvinylidene chloride film, a polyethylene film, or the like. The pliable material is secured to generally rigid frame 60 in order to form the inner container. The frame 60 is constructed from a material such as polystyrene, cellulose acetate, or other such plastic; wax coated cardboard; or the like. Preferably the frame has a cup-like shape, cone-like shape, or the like, wherein the open portion thereof meets the pliable material to form the inner container, and the frame forms the portion of the inner container which is positioned towards the output end of flavor delivery article. The surface area of the frame relative to the surface area of the pliable material can vary. Preferably, the pliable material has a greater surface area than that of the frame in order to allow for adequate collapse of the pliable material upon withdrawal of the liquid. The inner container can be held in place within the outer container by cellulose acetate plug 62 which circumscribes the generally rigid frame 60 and maintains contact with the inner surface of the outer container. The plug extends along the length of the frame for a sufficient distance to provide the necessary support of the inner container within the outer container. A path of airflow through the outer container is provided by a plurality or series of passages 64 and 66 which extend longitudinally through the plug 62. The passages also can be in the form of grooves, or other such configuration. Other means for supporting and holding the inner container in place within the outer container includes similarly positioned screen like materials, corrugated materials, or other such materials capable of providing a path of airflow through the outer container.

Inner container 14 contains liquid 16 which is capable of forming an aerosol under conditions provided during use of the flavor delivery article. Preferably, the liquid is a liquid flavorant. In one aspect, the flavor characteristics of the liquid flavorant can be provided by the liquid itself, as well as by other flavorants which can be added thereto. In another aspect, the flavor characteristics of the liquid flavorant can be provided by a liquid carrier having a flavorant added thereto. Liquids useful herein include aqueous liquids, organic liquids, and combinations thereof. Examples of suitable liquids include water; alcohols such as ethanol; essential oils such as cinnamon oil and peppermint oil; water-alcohol mixtures such as ethanol-water, water-polyhydric alcohol mixtures such as water-glycerol, water-triethylene glycol or water-propylene glycol; alcohol-alcohol mixtures such as ethanol-glycerol; alcohol-essential oil mixtures; water-essential oil mixtures; and the like.

Flavorants which are employed in combination with liquid carriers can include any of a wide variety of flavoring agents which can be contained in the liquid carrier. For example, flavor concentrates, sugars, etc., can be contained in water, water-alcohol mixtures, and the like. Numerous flavorants such as flavor concentrates are commercially available. Flavorants useful herein include those compositions providing flavors such as fruit, candy, menthol, liqueur, coffee, spice, chocolate, licorice, and the like. Of particular interest are flavorants such as nicotine or tobacco extract materials which provide a taste similar to cigarette mainstream tobacco smoke.

The amount of liquid contained in the inner container typically is an amount sufficient to provide from about 5 to about 15, preferably from about 7 to about 12 puffs of aerosol. The volume of a puff of aerosol generally varies from about 20 ml to about 60 ml, most generally from about 25 ml to about 35 ml. In particular, when the flavor delivery article is drawn upon by the user (eg., as in the puffing of a cigarette) a volume of aerosol is received by the user. Generally, the average user takes a puff over a time period which lasts from about 1 second to about 2.5 seconds, preferably from about 1.5 second to about 2 seconds.

The inner container is in flow communication with delivery means 18 which provides for transfer of the liquid from the inner container to a point nearer the mouthend of the article. Preferably, the liquid is transferred from the inner container into the mouthend piece of the flavor delivery article. The delivery means includes input region 74 which is positioned in order to receive liquid 16 from inner container 14, and output region 76 which is positioned towards the output end 25 of the flavor delivery article relative to the inner container. Typically, the delivery means extends from the inner container towards the output end of the flavor delivery article. Generally, the length of the delivery means is greater than the cross sectional area thereof. Preferably, the delivery means has a generally cylindrical shape. The delivery means has at least one opening 77 therein or passageway therethrough. Each opening preferably extends along the length of the delivery means in order to form a capillary-type tube. Examples of suitable delivery means include plastic tubes, hollow needles, capillary tubes, etc., which extend from the inner container. For example, a hollow needle can be inserted into the output end of the inner container 14 and held in place therein using wax, or other such sealant. Alternatively, the inner container can be equipped with a plastic tube which extends from the output end of the inner container.

The opening 77 within the delivery means generally has a circular cross sectional shape, although cross sectional shapes such as ovoidal, star shaped, etc., can be employed. It is preferable that the delivery means and the opening therein each extend in a substantially direct or linear manner from the inner container toward the output end of the flavor delivery article. However, it is possible for the delivery means and the opening therein to extend from the inner container to the point at which the delivery means is open to the atmosphere in a sinusoidal manner, a helical manner, or other such manner.

The opening 77 of the delivery means has a cross sectional area which is dependent upon factors such as the longitudinal length of the delivery means, the character of the liquid which forms the aerosol, the draft characteristics of the flavor delivery article, the type of aerosol which is desired, and other such factors. For any particular liquid, the cross sectional area of the opening is determinative of the type of aerosol obtained for the airflow rates and pressure drop experienced by the flavor delivery article during use. For example, a liquid of a particular viscosity cannot pass through an opening of a delivery means under the normal conditions of pressure drop experienced when the opening has a cross sectional area which is undersized or very small. Alternatively, an opening having an overly large cross sectional area can provide the tendency for a low viscosity liquid to pass from the delivery means in the form of a stream. For example, the type of delivery of liquid depends upon the cross sectional area of the opening of the delivery means, the surface wettability of the delivery means, the viscosity of the liquid, the surface tension of the liquid, and other such factors. Typically, such factors are selected such that under conditions of normal use, the desired amount of flavorant is obtained in the desired form of aerosol. It is preferable for desirable quality aerosol formation and for the desired volume of aerosol to use a flavor delivery article having the highest possible velocity airflow therethrough, the highest possible pressure drop, and opening in the delivery means having the smallest possible cross sectional area. Typically, smaller sized openings provide an aerosol in the form of a fine mist. Generally, for a liquid having a viscosity and surface tension approximately equal to water, an opening of from about 20 gauge to about 30 gauge, preferably from about 22 gauge to about 25 gauge, is suitably employed. Generally, openings of lower gauge (i.e., larger size) are useful for liquids of higher viscosity.

The delivery means 18 is held in place within (i.e., mounted in) the outer container by cellulose acetate plug 78, or other such means. The plug circumscribes the delivery means and maintains contact with the inner surface of the outer container. A path of airflow through the outer container is provided by a plurality or series of passages 79 and 80 which extend through the plug.

Airflow acceleration means 20 is positioned within the outer container in the region therein between the inner container and the extreme output end of the flavor delivery article. Preferably, the airflow acceleration means has the form of a baffle 81 having aperture 83. Typically, the baffle has a disk like shape, and is positioned substantially perpendicular to the direction of the airflow through the outer container. The baffle is constructed from a material which is capable of substantially impeding the flow of air through the outer container. For example, the baffle can be constructed from thermoplastic materials such as polypropylene, polyethylene, etc., cardboard, and the like. The baffle is integrally formed within the outer container or is positioned to fit snugly within the outer container using means such as glue, frictional forces, and the like, such that no significant airflow occurs between the baffle and the inner periphery of the outer container. Generally, the thickness of the baffle is sufficient to provide the desired pressure drop of the flavor delivery article. Typically, a baffle thickness of about 1 mm to about 5 mm, preferably about 2 mm is usefully employed for most applications. For the draft characteristics desired, a baffle having a greater thickness typically can have a larger aperture.

When airflow acceleration means is a baffle, aperture 83 of the baffle extends therethrough such that airflow passing through the outer container is passed through the aperture. The aperture 83 is of a small enough size to cause the air flowing through the outer container to experience an acceleration as the air flows therethrough. For example, a baffle having disk like shape and positioned transversely to the longitudinal axis of the flavor delivery article can include the aperture extending therethrough in a direction substantially parallel to the longitudinal axis of the flavor delivery article.

The aperture 83 generally has a circular cross sectional shape, although other cross sectional shapes can be employed. The cross sectional size of the aperture can vary, but is generally dependent upon factors such as the cross sectional size of the delivery means, the desired draft characteristics of the flavor delivery article, and other such factors. The cross sectional area of the aperture is greater than the cross sectional area of the delivery means. The cross sectional size of the aperture is not overly large in order that the desired acceleration of airflow is provided; while the cross sectional size is not so small in order that pressure drop provided thereby is not overly high.

As used herein, the term "pressure drop" in reference to the flavor delivery article itself is meant that pressure difference between atmospheric pressure and that pressure at the exit (or extreme mouthend) point of the article, as measured at a given flow rate through the article. Typical pressure drop values for articles of this invention range from about 50 mm to about 200 mm, preferably from about 120 mm to about 175 mm, of water pressure drop at 25 ml/sec. of air flow rate.

Output region 76 of the delivery means and airflow acceleration means 20 are arranged in a relationship such that liquid can be dispersed, nebulized or entrained in an aerosol form from the output region of the delivery means and into the airflow passing through the acceleration means. In particular, the output region of the delivery means and the airflow acceleration means are arranged with respect to one another such that airflow through the outer container undergoes an acceleration upon passing through aperture 83 thereby creating a region of lower pressure adjacent (i.e., in the vicinity of) the output region of the delivery means relative to that pressure experienced by the liquid contained within the inner container. The liquid at the output region of the delivery means can be thereby transferred into the path of airflow.

For embodiments shown in FIGS. 1 and 2, the desired pressure drop experienced by the liquid at the output region of the delivery means relative to that pressure experienced by the liquid contained within the inner container is provided by vent 86 located in the inner container. The vent allows air to enter the inner container, thereby producing a pressure at the upstream portion of the inner container and allowing the liquid at the output region of the delivery means to experience a pressure drop relative to that pressure experienced by the liquid contained within the inner container during the time that the flavor delivery article is being drawn upon during use thereof. The vent preferably is located in the inner container at the furthest possible distance toward the air input end of the flavor delivery article. The relatively large distance between the vent and the output region of the delivery means is believed to be a factor towards providing the greatest possible pressure drop therebetween.

The vent preferably has the form of a single hole or aperture in the inner container, although more than one vent can be employed if desired. The size of the vent can vary; and is generally small enough to prevent a liquid having a particular surface tension and being within the inner container from dripping, leaking, spilling, etc., from the flavor delivery article during storage and/or use thereof. However, the vent has a size which is large enough to readily permit passage of air into the inner container thereby providing the desired pressure drop characteristics to the flavor delivery article. Preferably, the vent has a cross sectional area which equals that of the opening of the delivery means. The vent preferably has a generally circular cross sectional shape; and the diameter thereof ranges from about 0.1 mm to about 0.6 mm, more preferably from about 0.2 mm to about 0.5 mm.

It is particularly desirable to seal the vent such that the liquid within the inner container is prevented from being released (eg., by leaking) prior to the time that the flavor delivery article is put to use. A convenient sealing means is filament 88 which extends through the vent and into the inner container. The filament has a length sufficient that it extends beyond intake end 24 of the flavor delivery article so as to be easily removable by the user. The filament has a diameter sufficient to effectively seal the vent, and generally is dependent upon the diameter of the aperture which forms the vent, the composition of the filament, and other such factors. Typically, filament 88 is nylon monofilament line, or other such material. If desired, the filament can extend through the inner container in order to seal the opening of the delivery means. At the time that the user desires to employ the flavor delivery article the sealing means is simply removed (i.e., by pulling the filament from the article).

If desired the inner container can be sealed, and the vent can be provided by the user using a puncturing means such as a pin, a needle, or the like.

For the embodiment shown in FIG. 1, the vent has the form of a single hole punched, drilled, etc., in the front-most wall of inner container (i.e., the surface of the inner container which is nearest the intake end of the flavor delivery article). For the embodiment shown in FIG. 2, the vent has the form of a single hole in plug 89 which seals the inner container. The plug can be a plastic cap, cork stopper, or the like. The plug 89 is held in place with the inner container (and thereby preventing leakage of the liquid within the inner container) using glue, wax, compressive forces, and the like.

In the embodiments shown in FIGS. 1 and 2, it is preferable that the longitudinal length of the inner container be greater than the diameter thereof. It is most preferable that the diameter of the inner container be sufficiently small in order that the surface tension of the liquid contained therein allows the liquid to extend across the inner diameter or cross section of the inner container during normal use thereof. For example, a cylindrical inner container having an inner diameter of 5 mm can provide good delivery of a liquid having a viscosity approximately equal to water.

Figure 4:
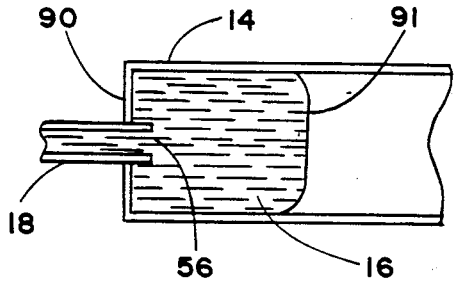
FIG. 4 is an enlarged, diagrammatic, longitudinal view of the embodiment shown in FIG. 2 showing a portion of the inner container partially filled with liquid.

Referring to FIG. 4, inner container 14 in the form of cylinder 38 has liquid 16 therein and has delivery means 18 positioned in face 90 of the cylinder which faces the output end of the flavor delivery article and extends substantially along the longitudinal axis of the article. The cross sectional diameter of the cylinder and the surface tension of the liquid are such that the liquid exhibits a propensity to fill a volume bounded by the cross section of the cylinder and thus form meniscus 91 across the cylinder. The extension of the liquid across the cross sectional area of the cylinder (i.e., substantially perpendicular to the longitudinal axis of the inner container) is particularly desirable in order that there is provided liquid in opening 92 where the delivery means meets the cylinder. A cylinder having an overly large cross sectional area, or a liquid having a surface tension which does not exhibit a propensity to fill the particular cross sectional area (i.e., to form a meniscus) can result in a flavor delivery article which is highly position sensitive during use due to the fact that there may not be provided a constant source of liquid to opening 92.

For the embodiment shown in FIG. 3, a pressure drop can be experienced between the liquid at the output region 76 of the delivery means 18 and the liquid 16 within the inner container by employing an inner container constructed from a pliable material. For example, the liquid can be contained in a bag, sack, or the like, which is constructed from a film of pliable plastic material. The pliability of the plastic material permits the inner container to collapse upon experiencing the pressure difference between the outer region thereof and the output region of the delivery means. The contraction of the inner container eliminates the need of a vent. A sealing means is unnecessary for such an embodiment due to the absence of the vent.

The draft characteristics and aesthetics of the embodiments shown in FIGS. 1, 2 and 3 can be further enhanced if desired, by positioning plug 93 of cellulose acetate, or other such material within the outer container near the air input end 24 of the flavor delivery article. The thickness of the plug, the draft characteristics thereof, and other such considerations can be selected for the particular flavor delivery article provided.

Referring to FIG. 1, it is desirable (particularly for aesthetic considerations) to simulate appearance of a filter by incorporating filter element 95 to the mouthend region. The filter element preferably extends from airflow acceleration means 20 to the extreme output end 25 of the flavor delivery article. The filter element typically is a hollow tube of cellulose acetate, polypropylene, or the like. The hollow region 97 of the filter element allows for the passage of aerosol from delivery means 18 to the mouth of the user.

Various arrangements of the output region of the delivery means relative to the airflow acceleration means are presented in FIGS. 5 through 10.

Figure 5:
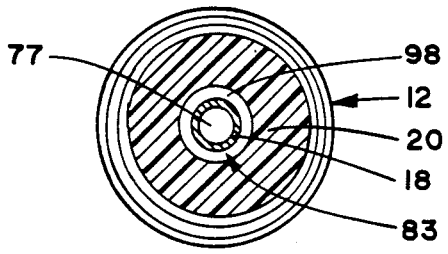
FIG. 5 is an enlarged, sectional view of the embodiment shown in FIG. 2 taken along lines 5—5 in FIG. 2.
Figure 6:
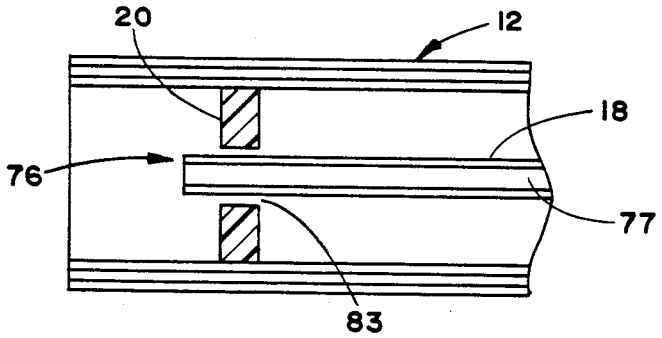
FIGS. 6–10 are enlarged, diagrammatic, partial longitudinal views of the output end of the liquid delivery means.

FIGS. 5 and 6 illustrate outer container 12 and disk shaped baffle 20 positioned therein transversely to the longitudinal axis of the flavor delivery article. Aperture 83 extends directly through the baffle near the center thereof. The aperture has a circular cross section. Delivery means 18 having passageway 77 (i.e., opening) therein extends parallel to the longitudinal axis of the flavor delivery article and through the aperture. The delivery means is in the form of a capillary tube, and the outer diameter thereof is smaller than the cross sectional area of the aperture 83. For example, about 70 to about 80 percent of the cross sectional area of the aperture is occupied by the delivery means. The delivery means preferably is centered concentrically within the aperture thus forming an annular space 98. The end of the delivery means (i.e., which forms a nozzle type opening) is positioned toward the output end of the flavor delivery article. The end of the delivery means is squared off so as to be generally perpendicular to the longitudinal axis of the flavor delivery article. Passageway 77 extends through the delivery means to output region 76 which is provided as a squared off end of the delivery means. The end 76 of delivery means 18 extends slightly beyond the output end surface of the baffle. By "slightly beyond" is meant that distance whereby the end of the delivery means can experience the effects of turbulence of the accelerated airflow which passes through the aperture thereby providing nebulization of the liquid. Preferably, end 76 of the delivery means is located at or near the point of maximum turbulence in order to maximize nebulization of the liquid.

Figure 7:
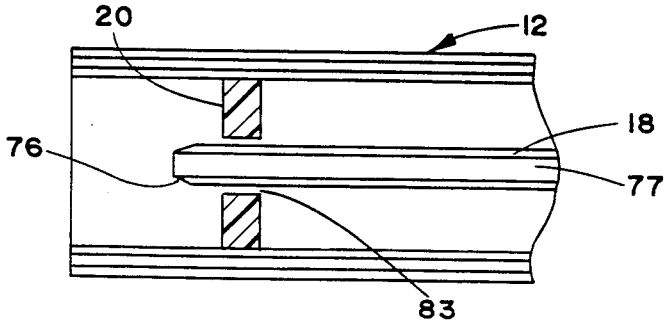
Figure 8:
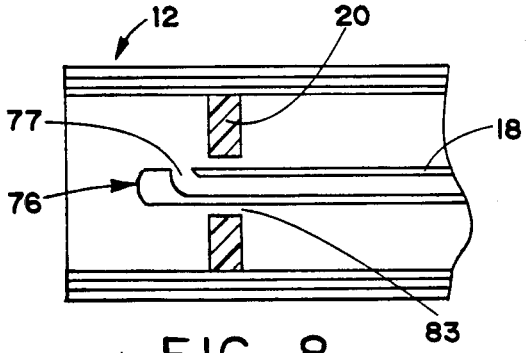

FIGS. 7 and 8 illustrate an outer container and the disk shaped baffle having the aperture therein substantially as described hereinbefore. Delivery means 18 has opening 77 therein. The delivery means, the positioning thereof and the opening therein are substantially described hereinbefore. In FIG. 7, output end 76 of the delivery means has the form of a point so as to form a convex type shape thereto. Alternatively, in an embodiment not shown, the end of the delivery means can be similarly fashioned so as to form a concave type shape thereto. In each of the embodiments, the opening extends directly through the end of the delivery means. In FIG. 8, the opening does not extend directly through the end of the delivery means but rather provides an exit region for the liquid along the side of the delivery means but near the end thereof.

Figure 9:
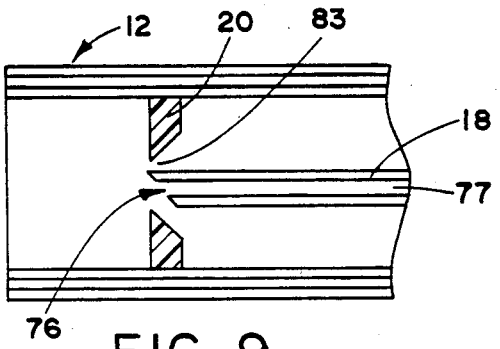

FIG. 9 illustrates outer container and disk shaped baffle substantially as described hereinbefore. Aperture 83 is fashioned in order that the diameter thereof is tapered, or gradually becomes smaller as the aperture extends through the baffle. Delivery means 18 has opening 77, and each are substantially as described hereinbefore. The positioning of the delivery means is substantially described hereinbefore, however, the end most point thereof 76 extends about to the output end surface of the baffle. The end 76 of the delivery means is fashioned at an angle whereby airflow through the aperture is in a direction approximately perpendicular to the surface of the extreme output end of the delivery means.

Figure 10:
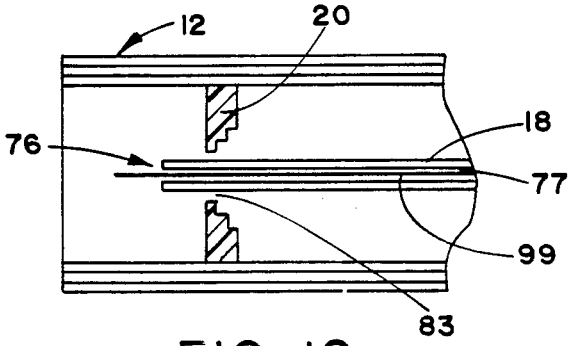

FIG. 10 illustrates outer container, disk shaped baffle, delivery means and the opening therein, substantially as described hereinbefore. The aperture has a somewhat beveled cross sectional shape in order that the diameter thereof gradually becomes smaller as the aperture extends through the baffle. Also shown is fine wire 99 which extends through opening 77 of delivery means 18 and extends slightly beyond output end 76 of the delivery means. The fine wire is believed to provide further dispersion or nebulization of the liquid.

It is understood that the particular embodiments described herein are only illustrative of the principles of this invention, and the various modifications can be made by those skilled in the art without departing from the scope and spirit of this invention. For example, ovoidal shaped flavor delivery systems can be manufactured.

The following example is provided to further illustrate the invention but should not be construed as limiting the scope thereof.

EXAMPLE 1

A cylindrical flavor delivery article illustrated in FIG. 2 is provided.

Conventional cigarette paper wrap is glued to the outer surface of a foil lined paper tube. The tube is formed from paper having aluminum foil of 0.35 mil thickness glued to one side thereof. The tube which forms the outer container has an outer diameter of 8.24 mm and a length of 100 mm.

The inner container is provided from a commercially available hypodermic needle plastic holder sold as Yale Needle Guard by Becton, Dickinson and Company. The volume of the inner container when fitted with a plastic cap is 0.5 ml. The holder includes 2 pieces (a tapering container having a length of 55 mm and a 17.5 mm plastic cap which fits so as to extend into the container) which form a combined length of about 60 mm. The inner container has a greatest outermost diameter of 5.6 mm. The outmost diameter is formed into a type of ring of about 3 mm in length. The ring is fitted with 4 to 8 grooves each having a width of 3 mm to 4 mm. The holder is fit snugly within the outer container. The foremost portion of the inner container is positioned 12.7 mm from the extreme input end the outer container.

The inner container contains 0.5 ml of a coffee liqueur liquid flavorant. The flavorant comprises 0.35 ml water, 0.1 ml ethanol and about 0.05 ml of a coffee flavor concentrate.

The vent is a hole having a 0.39 mm diameter which passes through the front face of the cap which covers the foremost portion of the inner container.

The delivery means is a 22 gauge metal hypodermic needle which extends from the output end of the inner container towards the extreme output end of the outer container. The needle is 33.75 mm long and has a squared off end. The outer diameter of the needle is 0.71 mm.

The air acceleration means is constructed from a circular polypropylene disk having a diameter of 7.72 mm which approximates the inner diameter of the outer container. The disk has a circular hole having a diameter of 1.02 mm drilled through the center thereof. The disk is positioned within the outer container such that the needle passes through the center of the circular hole therein. The top of the needle extends 2.3 mm beyond the output end surface of the disk.

The inner container and the hypodermic needle are held in place within the outer container using a cellulose acetate plug about 6 mm in length, and having 4 to 8 grooves therein.

A 10 mm plug of cellulose acetate is positioned near the extreme input portion of outer container. A plug of cellulose acetate tubes is positioned within the outer container at the output end of the disk and extends longitudinally along the tube up to the end point of the needle.

The article can deliver a 40 ml volume of aerosol over a 2 second period while delivering 0.05 ml of liquid from the inner container to form the aerosol. The pressure drop of the article for the conditions of use is from 140 mm to 160 mm of water as determined using an encapsulated pressure drop tester sold commercially as Model No. FTS-300 by Filtrona Corporation at 17.5 cc/sec. airflow rate.

What is claimed is:

1. A flavor delivery article comprising:

(a) an outer container providing a pathway for airflow therethrough;

(b) an inner container disposed within the outer container and containing a liquid, the inner container having a delivery means having an output region for output of the liquid;

(c) an airflow acceleration means located near the output region of the delivery means; and (d) a mouthend region; wherein the airflow acceleration means is a baffle in the form of a disk having an aperture therethrough; wherein the output region of the delivery means and the airflow acceleration means are arranged in a relationship such that puff induced airflow through the outer container experiences a pressure drop adjacent the output region of the delivery means relative to the pressure experienced by the liquid contained within the inner container, which pressure drop is sufficient to disperse liquid from the output region of the delivery means into the airflow to form an aerosol in the mouthend region; and wherein the output end of the delivery means extends through the aperture slightly beyond the output end surface of the disk.

2. A flavor delivery article comprising:

(a) an elongated outer container having a mouthend;

(b) an inner container mounted in the outer container and containing a liquid;

(c) a delivery means mounted in the outer container, the delivery means being in flow communication with the inner container and having at least one passage therethrough for transferring the liquid from the inner container to a point nearer the mouthend;

(d) means for providing for passage of air through the outer container; and (e) an airflow acceleration means located adjacent the opening of the delivery means in order to form an aerosol from the liquid in the delivery means upon puffing;

wherein the opening in the delivery means extends slightly beyond the airflow acceleration means towards the mouthend of the article.

3. A flavor delivery article comprising:

(a) an elongated outer container having a mouthend;

(b) an inner container mounted in the outer container and containing a liquid, wherein the container has a cross sectional area such that the liquid therein forms a meniscus across the cross sectional area of the inner container;

(c) a delivery means mounted in the outer container, the delivery means being in flow communication with the inner container and having at least one passage therethrough for transferring the liquid from the inner container to a point nearer the mouthend;

(d) means for providing for passage of air through the outer container; and (e) an airflow acceleration means located adjacent the opening of the delivery means in order to form an aerosol from the liquid in the delivery means upon puffing.

* * * * *